US006290412B1

(12) United States Patent
Birmingham

(10) Patent No.: US 6,290,412 B1
(45) Date of Patent: Sep. 18, 2001

(54) BUTTER MELTER AND APPLICATOR

(75) Inventor: James O. Birmingham, 4744 N. 41st St., Milwaukee, WI (US) 53209

(73) Assignee: James O. Birmingham, Milwaukee, WI (US)

( * ) Notice: Subject to any disclaimer, the term of this patent is extended or adjusted under 35 U.S.C. 154(b) by 0 days.

(21) Appl. No.: 09/713,804

(22) Filed: Nov. 16, 2000

(51) Int. Cl.[7] ..... A46B 11/00
(52) U.S. Cl. ..... 401/12; 401/11; 401/9
(58) Field of Search ..... 401/12, 11, 9; 99/345, 348, 537, 395, 409; 118/13; D7/670

(56) References Cited

U.S. PATENT DOCUMENTS

| | | | | |
|---|---|---|---|---|
| D. 365,980 | * | 1/1996 | Matata et al. | D7/670 |
| 889,434 | * | 6/1908 | Bustanoby . | |
| 2,096,726 | * | 10/1937 | Barton . | |
| 2,278,108 | * | 3/1942 | Joyce . | |
| 2,527,149 | * | 10/1950 | Peterson . | |
| 2,556,092 | * | 6/1951 | Kimball . | |
| 2,691,877 | * | 10/1954 | Frolich . | |
| 2,756,498 | * | 7/1956 | Wasser . | |
| 2,811,844 | * | 11/1957 | Selmer . | |
| 2,897,776 | * | 8/1959 | Black et al. . | |
| 3,308,269 | * | 3/1967 | Stocker . | |
| 3,805,384 | * | 4/1974 | Falcone . | |
| 3,897,159 | * | 7/1975 | Ball et al. . | |
| 4,241,852 | | 12/1980 | Klem . | |
| 4,408,919 | * | 10/1983 | Wolff et al. | 401/12 |
| 4,676,186 | | 6/1987 | Drainas et al. . | |
| 4,892,225 | | 1/1990 | Zelewski et al. . | |
| 4,964,745 | | 10/1990 | Deitz et al. . | |
| 5,323,692 | * | 6/1994 | Grzywna et al. . | |
| 5,858,089 | * | 1/1999 | Martinovic | 118/13 |
| 5,906,856 | | 5/1999 | Roden et al. . | |

* cited by examiner

*Primary Examiner*—Gregory L. Huson
*Assistant Examiner*—Khoa Huynh

(57) ABSTRACT

A butter melter and applicator (10) having a height in a range between ten inches and fifteen inches and a width in a range between three inches and five inches to accommodate the height and width of a corn cob. The container bottom (12B) has a container bottom cone (12BA) securely affixed thereto extending upwardly therefrom functioning to hold a distal end of a corn cob therein. The butter melter and applicator (10) further has a handle (14) attached to container side (12S). A lid (16) is sealably removably attachable to the container top (12T). The lid (16) has a lid knob (16A) rotatably mounted there through. A lid fork (16B), removably insertable into an opposite distal end of a corn cob, is securely affixed to the lid knob (16A) extending downwardly therefrom functioning to allow a user to place the butter melter and applicator (10) on a side and rotate the corn cob by rotating the lid knob (16A) thereby coating the corn cob with butter. The lid (16) further has a lid lip (16C) having a lid skirt (16D) having a slightly narrower diameter then a diameter of the container top (12T), the lid skirt (16D) extends downwardly from the lid lip (16C) functioning to improve sealability between the lid (16) and the container (12).

5 Claims, 3 Drawing Sheets

BUTTER MELTER AND APPLICATOR

BACKGROUND OF THE INVENTION

1. Field of the Invention

The present invention relates to butter melter. More particularly, the present invention relates to butter melter and applicator.

2. Description of the Prior Art

Numerous innovations for a butter melter and applicator have been provided in the prior art that are described as follows. Even though these innovations may be suitable for the specific individual purposes to which they address, they differ from the present invention as hereinafter contrasted.

In U.S. Pat. No. 5,906,856, titled, Process for the preparation of a low-calorie, liquid butter substitute, invented by Roden, et. al., A liquid butter replacement exhibits a pleasant fat-like mouth feel despite a very low or no fat content, good color, good flavor, and a degree of fat-like melt without causing toast or other similar substrate to which the product is applied to become soggy due to moisture release. A flowable fat mimetic is prepared from an aqueous solution comprising a cross-linkable carbohydrate gelling composition (preferably pectin) and at least one gelling agent (preferably a calcium salt) that together form a heat-stable inner gelled phase which is agitated to produce gel particles that provide an organoleptic sensation similar to fat. The weight of the fat mimetic is at least about 75% of the weight of the butter substitute. The flowable fat mimetic is then combined with an second, continuous outer phase containing an unhydrated heat-reversible or heat-thinning, water-soluble gelling agent, and preferably salt and milk or milk solids. The product so formed exhibits good melting properties, little syneresis and maximal flavor impact similar to a full fat margarine, but with little or no fat.

In U.S. Pat. No. 4,964,745, titled, Container for storing and dispensing semi-soft sticklike food products invented by Deitz, et. al., A container for storing and dispensing semi-soft sticklike food products, such as butter, oleomargarine, and the like can have the elements thereof oriented and re-oriented into positions that are most comfortable to the particular user. The container can be disassembled for easy cleaning.

In U.S. Pat. No. 4,892,225, titled, Cooling container for butter or the like, invented by von Zelewski, et. al., A butter container or like container for preserving a foodstuff has an upwardly open receptacle forming the base, a plate at an upper part of this receptacle for holding the foodstuff and having a portion covered with an absorbent material dipping into water contained in the receptacle. The cover comprises a thin inner wall with an extension dipping into the water and covered on its outer surface with an absorbent material, an outer lid spaced from the inner wall, a water directing channel connecting the inner wall to the outer lid, and perforations in the lid through which water can be poured into the cover to pass via the channel into the receptacle.

In U.S. Pat. No. 4,676,186, titled, Butter rolling device, invented by Drainas, et. al., A butter rolling device for applying butter/margarine to a selected surface of an item of food is disclosed. The butter rolling device (10) comprises a reservoir (12) for receiving and melting butter/margarine, the reservoir (12) defining an upper opening (28) for accessing the reservoir (12). The device (10) further comprises a rolling drum (16) rotatably mounted in the reservoir (12), the drum (16) comprising cylindrical walls (30) defining an exterior annular rolling surface (32) for being coated with butter/margarine and for rotatably engaging the selected surface of the item of food whereby butter/margarine is transferred to such selected surface. Means are also provided for rotatably mounting the rolling drum (16) in the reservoir (12).

In U.S. Pat. No. 4,241,852, titled, Dispensing container for butter having follower, invented by Klem. A dispensing container for storing and dispensing pre-packaged quarter pound segments of softened butter or similar dispensable materials. Segments of butter pre-packaged in plastic envelopes are constrained between a movable butter feed plate and a stationary base in conjunction with a sealing plate within the container for dispensing butter therefrom. The sealing plate includes a hinged sealing edge that cooperates with a rigid feed lip at the front of the container to define a feed passageway and to seal an end of the envelope that is disposed therebetween. Depressing the feed plate compresses the pre-softened butter within the packaging envelope to open the feed passageway and force butter through the envelope end. When the feed plate is released, the feed passageway is automatically sealed.

The aforementioned patents differ from the present invention because the patented inventions lack the following features: stainless steel with sealable cover which can be replaced in refrigerator for reuse; and shaped like corn, long and slender, to facilitate rolling and coating cob in butter.

Numerous innovations for a butter melter and applicator have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a butter melter and applicator, preferably constructed from stainless steel, which can be placed back in the refrigerator for reuse.

The types of problems encountered in the prior art are plates which coat corn cobs are inefficient with the use of butter.

In the prior art, unsuccessful attempts to solve this problem were attempted namely: plates which conform to the shape of a corn cob and/or brush type apparatuses. However, the problem was solved by the present invention because it included a rotating means to coat the cob.

Innovations within the prior art are rapidly being exploited in the field of effective food preparation devices.

The present invention went contrary to the teaching of the art which describes and claims plates, butter applicators and brush devices.

The present invention solved a long felt need for a refrigeratable device for butter reuse.

Accordingly, it is an object of the present invention to provide a butter melter and applicator having a container, handle, and lid.

More particularly, it is an object of the present invention to provide the container has a container top, container bottom, and container side.

In keeping with these objects, and with others which will become apparent hereinafter, one feature of the present invention resides, briefly stated, in the container bottom having a container bottom cone extending upwardly therefrom.

When the container side is designed in accordance with the present invention, it has a container side corn texture.

In accordance with another feature of the present invention, lid has a rotatable lid knob with a lid fork extending downwardly therefrom.

Another feature of the present invention is that the lid further has a lid lip with a lid skirt extending downwardly therefrom.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—butter melter and applicator (10)
12—container (12)
12T—container top (12T)
12B—container bottom (12B)
12BA—container bottom cone (12BA)
12S—container side (12S)
12SA—container side corn texture (12SA)
14—handle (14)
16—lid (16)
16A—lid knob (16A)
16B—lid fork (16B)
16C—lid lip (16C)
16D—lid skirt (16D)

DESCRIPTION OF THE PREFERRED EMBODIMENT

Figure 1:
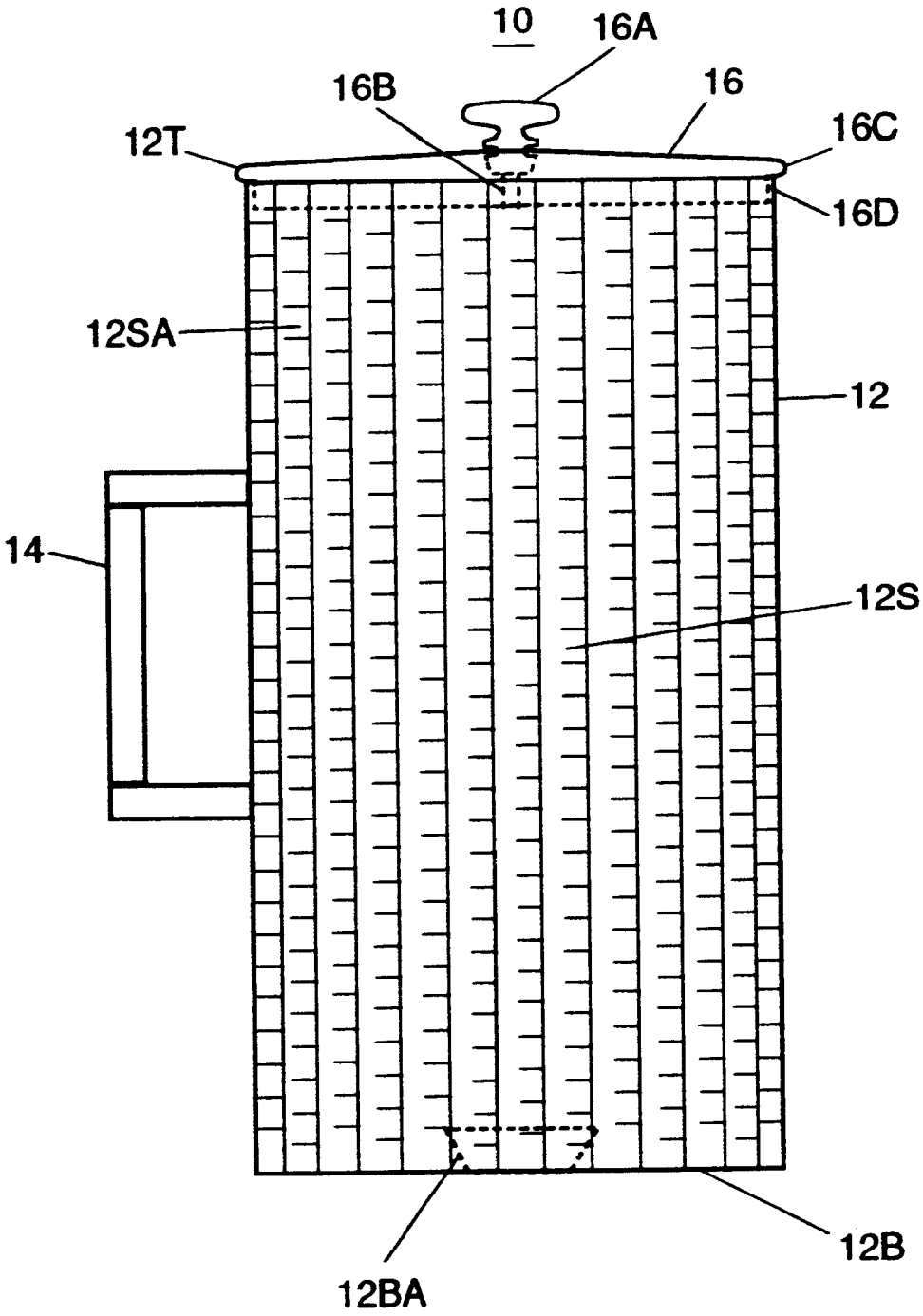
FIG. 1 is a side view of a butter melter and applicator (10).

Referring to FIG. 1 which is a side view of a butter melter and applicator (10) comprising a container (12) which comprises a container top (12T), a container bottom (12B), and a container side (12S). The container (12) having a height in a range between ten inches and fifteen inches and a width in a range between three inches and five inches to accommodate the height and width of a corn cob. The container bottom (12B) comprises a container bottom cone (12BA) securely affixed thereto extending upwardly therefrom functioning to hold a distal end of a corn cob therein The container side (12S) preferably comprises container side corn texture (12SA).

The butter melter and applicator (10) further comprises a handle (14) attached to container side (12S).

Figure 2:
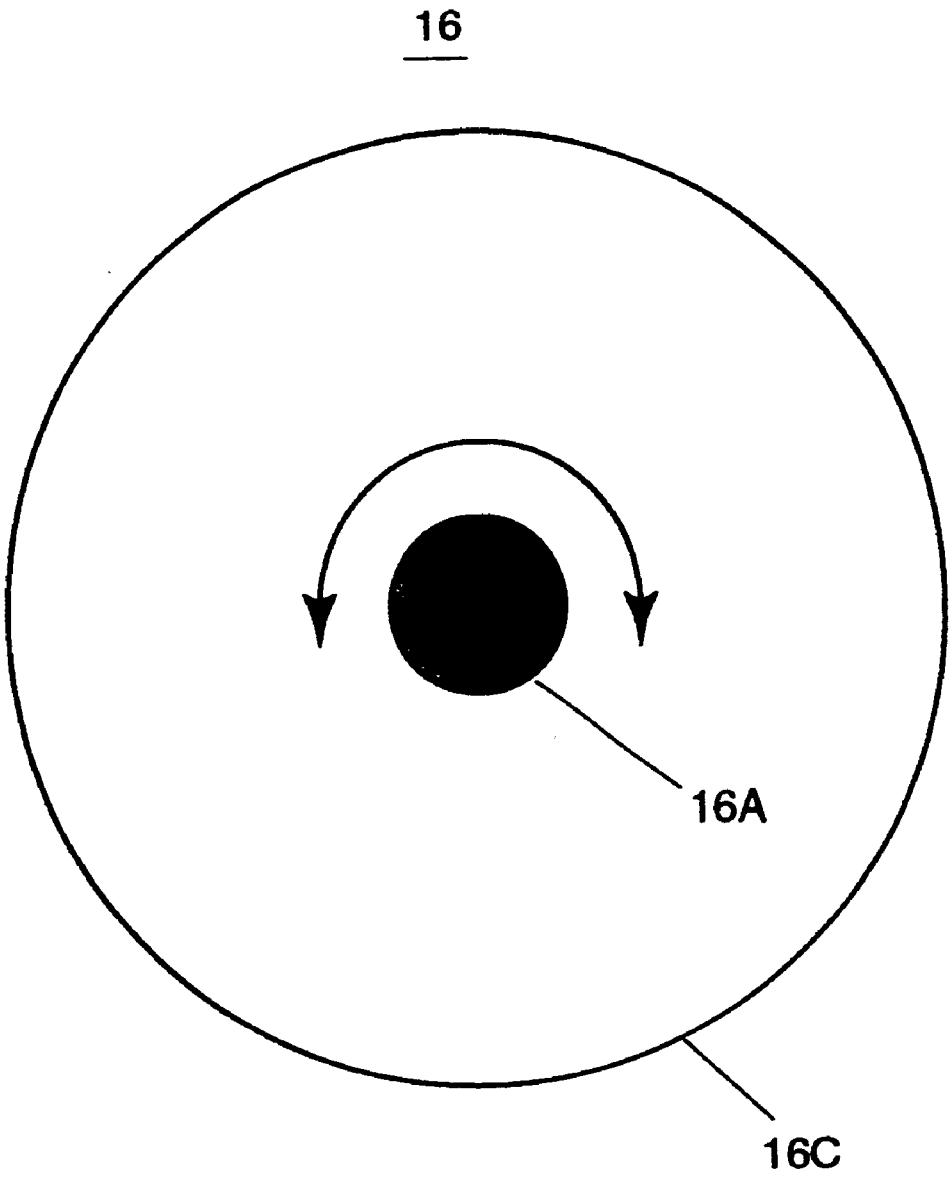
FIG. 2 is a top view of a lid (16).
Figure 3:
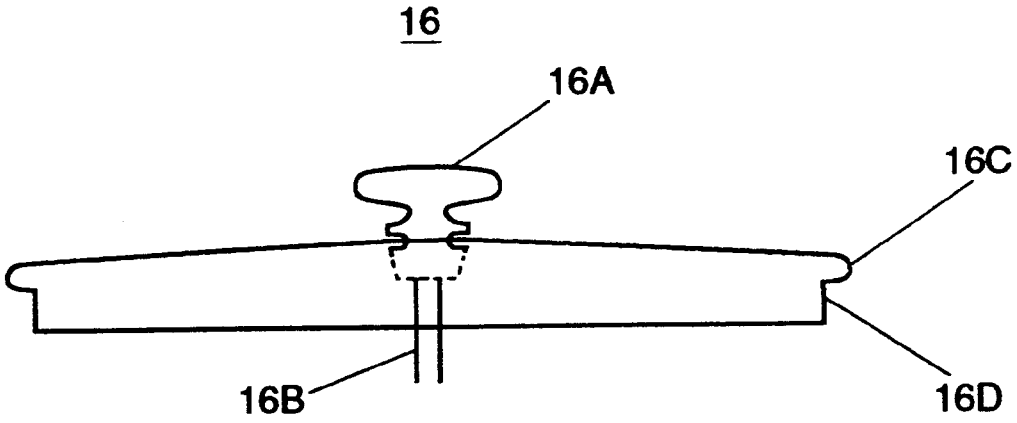
FIG. 3 is a side view of a lid (16).

Now referring to FIGS. 2 and 3 which are a top and side view of a lid (16), respectively. The butter melter and applicator (10) further comprises a lid (16) sealably removably attachable to the container top (12T). The lid (16) comprises a lid knob (16A) rotatably mounted there through. A lid fork (16B), removably insertable into an opposite distal end of a corn cob, is securely affixed to the lid knob (16A) extending downwardly therefrom functioning to allow a user to place the butter melter and applicator (10) on a side and rotate the corn cob by rotating the lid knob (16A) thereby coating the corn cob with butter. The lid (16) further comprises a lid lip (16C) having a lid skirt (16D) having a slightly narrower diameter then a diameter of the container top (12T), the lid skirt (16D) extends downwardly from the lid lip (16C) functioning to improve sealability between the lid (16) and the container (12).

The butter melter and applicator (10) is preferably manufactured from a non-stick material. The butter melter and applicator (10) is preferably manufactured from stainless steel de to the fact that most users will replace the container into the refrigerator after use.

It will be understood that each of the elements described above, or two or more together, may also find a useful application in other types of constructions differing from the type described above.

While the invention has been illustrated and described as embodied in a butter melter and applicator, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

What is claimed is:

1. A butter melter and applicator (10) comprising:

A) a container (12) which comprises a container top (12T), a container bottom (12B), and a container side (12S), the container (12) having a height in a range between ten inches and fifteen inches and a width in a range between three inches and five inches, wherein the container bottom (12B) comprises a container bottom cone (12BA) securely affixed thereto and extending upwardly therefrom functioning to hold a distal end of a corn cob therein;

B) a handle (14) attached to the container side (12S); and

C) a lid (16) sealably removably attachable to the container top (12T), wherein the lid (16) comprises a lid knob (16A) rotatably mounted therethrough, a lid fork (16B), removably insertable into an opposite distal end of the corn cob, is securely affixed to the lid knob (16A) and extending downwardly therefrom functioning to allow a user to place the butter melter and applicator (10) on the container bottom (12B) and rotate the corn cob by rotating the lid knob (16A) thereby coating the corn cob with butter.

2. The butter melter and applicator (10) as described in claim 1, wherein the container side (12S) comprises container side corn texture (12SA).

3. The butter melter and applicator (10) as described in claim 1 is manufactured from a non-stick material.

4. The butter melter and applicator (10) as described in claim 1 is manufactured from stainless steel.

5. The butter melter and applicator (10) as described in claim 1, wherein the lid (16) further comprises a lid lip (16C) having a lid skirt (16D) having a slightly narrower diameter then a diameter of the container top (12T), the lid skirt (16D) extends downwardly from the lid lip (16C) functioning to improve sealability between the lid (16) and the container (12).

* * * * *